United States Patent [19]

Lewin

[11] 4,388,675

[45] Jun. 14, 1983

[54] INDIRECT LIGHTING FIXTURE

[76] Inventor: Ian Lewin, 11408 St. Andrew's Way, Scottsdale, Ariz. 85254

[21] Appl. No.: 216,241

[22] Filed: Dec. 15, 1980

[51] Int. Cl.[3] ..... F21S 3/00

[52] U.S. Cl. ..... 362/225; 362/151; 362/241; 362/247; 362/260; 362/297; 362/346

[58] Field of Search ..... 362/147, 151, 215, 342, 362/217, 219, 225, 227, 241, 247, 260, 297, 346

[56] References Cited

U.S. PATENT DOCUMENTS

| | | | |
|---|---|---|---|
| 2,556,690 | 6/1951 | Guth | 362/342 |
| 3,829,677 | 8/1974 | De Llano | 362/346 |
| 4,112,483 | 9/1978 | Small | 362/217 |
| 4,174,533 | 11/1979 | Barthes | 362/346 |

*Primary Examiner*—Donald P. Walsh
*Attorney, Agent, or Firm*—LaValle D. Ptak

[57] ABSTRACT

An indirect multiple bulb fluorescent light fixture has an elongated rectangular housing with inverted V-shaped reflector members located beneath each of the bulbs and with an additional inverted V-shaped reflector member located between each pair of bulbs in the fixture. All of the interior surfaces of the fixture, including the side walls of the rectangular housing for the fixture, have specular surfaces. The angles of the V-shaped reflector members are selected to cause substantially all of the light emanating from the bulbs to be reflected out of the fixture and to minimize light reflected back into the bulbs for dispersing the light emanating from the fixture uniformly on the ceiling above the fixture without requiring translucent covers or other diffusers. This results in a significantly improved efficiency of the fixture over conventional fixtures which rely upon translucent covers to effect the desired light dispersion.

6 Claims, 2 Drawing Figures

INDIRECT LIGHTING FIXTURE

BACKGROUND OF THE INVENTION

Multiple-bulb fluorescent lighting fixtures have become extremely popular for providing illumination of relatively wide expanses of space in large rooms, such as encountered in factories, offices, stores, and the like. These lighting fixtures have gained widespread acceptance because of the significantly reduced costs of operating them as contrasted with incandescent light fixtures and, further, because of the generally non-glare and even distribution of light which can be obtained from such fixtures. Even so, fluorescent lighting fixtures in common use today are relatively inefficient. Generally, these fixtures employ translucent covers or the like over the fluorescent bulbs to disperse the light and spread it more evenly in the area to be illuminated. Obviously, if a translucent cover is placed over the fixture, a substantial loss of lighting efficiency occurs simply by virtue of the use of such a cover.

In addition, the housings for most fluorescent lighting fixtures, which use bulbs in the form of relatively long tubes on the order of four feet (4') in length, do little toward recovering and utilizing the light which is directed from the bulb onto the back and sides of the housing itself. The housings generally are of flat, rectangular configuration and they are painted white, which serves to reflect some of the light back out into the room. At the same time, however, much of the light emanating from the bulbs in multiple-bulb fixtures is directed directly from one bulb to another, or is reflected from the back of the fixture housing into the same or another bulb. All of this is wasted energy, which results in a reduced light output from the maximum which could be obtained from such a fixture. In addition, the light and heat which is reflected from the housing back into the bulbs tends to raise their temperature; and, as is well known, this in turn reduces the overall efficiency of operation of the bulbs.

In the past, some recognition of the inefficiency of standard fluorescent light fixtures has been noted and attempts have been made to increase the efficiency of the light output from such fixtures by placing between adjacent bulbs of multiple-bulb fixtures an inverted V-shaped elongated reflecting surface. Such an effort at increased efficiency is disclosed in the patents to Bodian et al, U.S. Pat. No. 2,864,939, issued Dec. 16, 1958, and Akely et al, U.S. Pat. No. 2,914,657, issued Nov. 24, 1959. Both of these fixtures are ceiling-type fixtures for directly lighting the room below, or the area below as in the case of Akely. The V-shaped reflectors, which are placed between the bulbs of these fixtures, do assist in recovering and spreading light which ordinarily would be lost in a conventional fixture not having the inverted V reflector units in it. A substantial amount of light and heat energy, however, is directed back into the bulbs in both of these fixtures; because the reflector placed behind the bulbs is the conventional flat surface used in most such fixtures. Thus, any light directed generally downwardly from the bulbs is reflected back into the bulbs. This light energy is lost and increases the temperature of the bulbs which, in turn, also reduces their efficiency. In addition, it also should be noted that the fixtures disclosed in both of these patents require a translucent cover to evenly disperse the light emanating from the fixtures since this is not accomplished by the shape of the reflectors themselves.

Another multiple-bulb or multiple-tube fluorescent lighting fixture utilized in a very specialized environment for lighting storefront show windows is disclosed in the patent to Campen, U.S. Pat. No. 2,335,735, issued Nov. 30, 1943. This fixture is designed with a stairstep-shaped reflector having an apex or point beneath each of the elongated bulbs of a multiple-bulb fixture in which the bulbs are relatively tightly packed together. Space-to-space distance between the bulbs, as shown in this patent, is less than the diameter of the bulbs themselves. There are no inverted V-shaped reflectors between adjacent bulbs in this fixture. From an examination of the shape of the reflector and the relatively close spacing of the bulbs, it is apparent that most of the light that is reflected from the bulbs onto the reflector behind them is reflected back into the bulbs themselves. The primary source of light from the fixture of Campen is direct light from the bulbs.

Single bulb fluorescent fixtures with enhanced reflectors for dispersing a more or less uniform pattern of light from the fixture are disclosed in the patents to Welch, U.S. Pat. No. 2,194,841, issued Mar. 26, 1940, and Netting, U.S. Pat. No. 2,323,073, issued June 29, 1943. The Welch patent discloses the placement of an inverted V-shaped reflector behind the single bulb with adjacent surfaces located to reflect the light from these surfaces onto other surfaces and direct it outwardly from the fixture. Much of the light from the bulb in the Welch reflector undergoes two (2) or three (3) reflections before it exits from the fixture. Consequently, there is a substantial loss of lighting efficiency as a result of the multiple reflections. The desired object of spreading the light which leaves the fixture is obtained at the cost of this reduced efficiency.

The Netting fixture employs a plurality of elongated reflective strips on each side of the single bulb used in the fixture with the strips being generally oriented in a concave curve cross-sectional configuration. In Netting, as in Welch, much of the light which issues from the half of the bulb facing the reflector undergoes multiple reflections resulting in reduced efficiency. As a consequence, the angular arrangement of the various reflecting surfaces results in a considerable reduction in the amount of light which issues from the fixture over that which could be obtained from a fixture minimizing the multiple reflections.

All of the above patents also are directed to light fixtures which are intended to be placed above the surface to be illuminated. In many installations, particularly commercial installations, indirect lighting is preferred. To maximize the efficiency of indirect lighting, it is desirable to have the fixture located near the ceiling, above the line of sight, with as wide as possible even light dispersion from the fixture. Furthermore, it is desirable to provide such a fixture which maximizes the amount of light reflected out of the fixture from each bulb of the fixture, if a multiple-bulb fixture is employed, and which provides a uniform illumination on the ceiling without requiring a translucent dispersing cover. An increase in even ten percent (10%) of the efficiency of such a fixture over standard fixtures would result in considerable savings in energy over the lifetime of operation of such a fixture.

SUMMARY OF THE INVENTION

It is an object of this invention to provide an improved light fixture.

It is another object of this invention to provide an improved fluorescent light fixture.

It is an additional object of this invention to provide an improved indirect fluorescent lighting fixture.

It is a further object of this invention to provide an improved multiple-bulb indirect lighting fixture having increased efficiency.

It is yet another object of this invention to provide an improved multiple-bulb fluorescent indirect lighting fixture having a reflector configuration capable of evenly dispersing light emanating from the fixture without the necessity of a translucent light dispersion cover for the lighting fixture.

In accordance with a preferred embodiment of the invention, an indirect multiple-bulb fluorescent light fixture includes a generally rectangular housing which has a base located beneath the bulbs of the fixture. Beneath each of the bulbs is located an inverted V-shaped reflector with the apex of the V located in alignment with the axis of the bulb which the reflector underlies on a line perpendicular to the plane of the base. Between each of the bulbs in the fixture is a second elongated inverted V-shaped reflector which extends parallel to the bulbs. The angles formed between the legs of each of the first and second V-shaped reflector members and the base and between the reflector members and the bulbs are selected to minimize light reflected back into the bulbs from the reflector members and to uniformly disperse light emanating from the fixture, with most of the reflected light undergoing only a single reflection.

DETAILED DESCRIPTION

Figure 1:
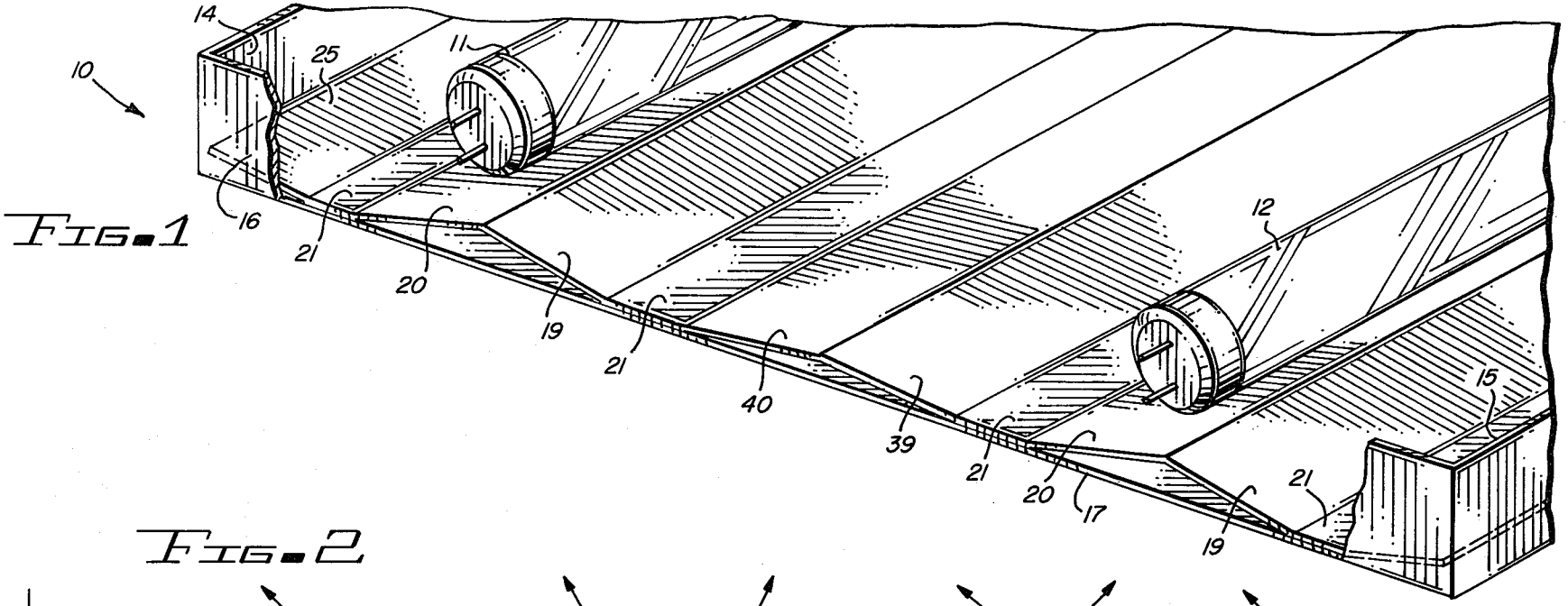
FIG. 1 is a partially cut-away perspective view of a preferred embodiment of the invention.
Figure 2:
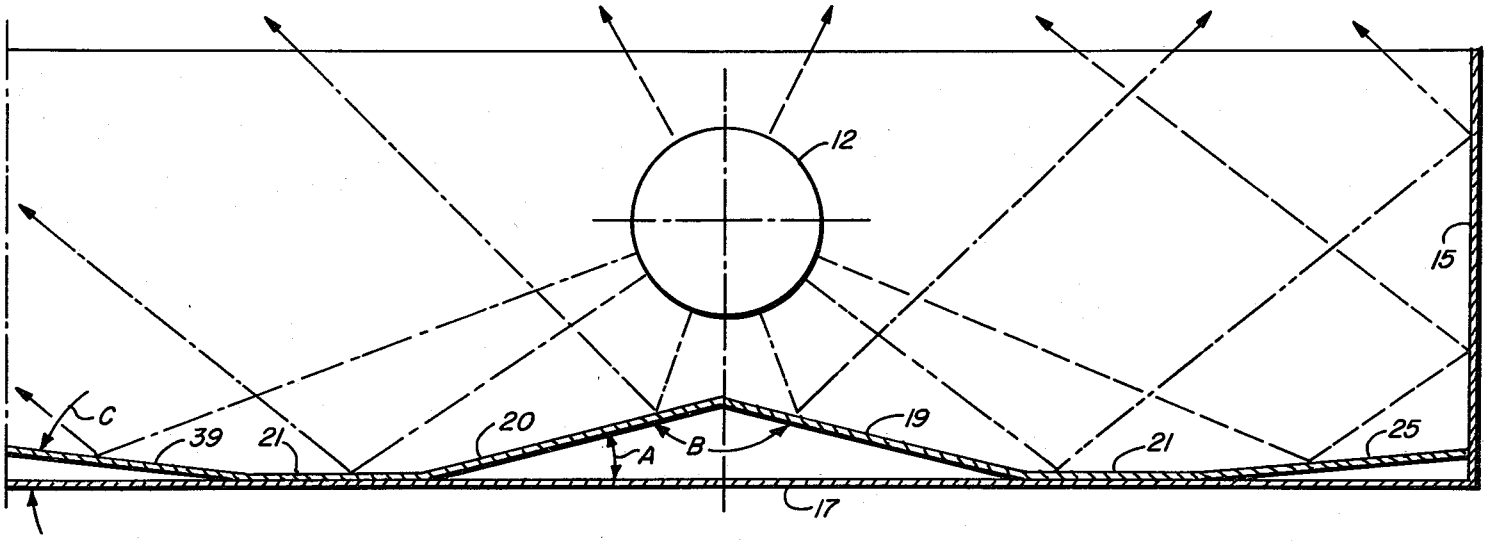
FIG. 2 is a cross-sectional view of a portion of the embodiment shown in FIG. 1, illustrating details thereof.

Reference now should be made to the drawing in which the same reference numbers are used in both FIGS. 1 and 2 to designate the same components.

The indirect fluorescent lighting fixture which is illustrated is carefully designed to optimize the efficiency of light output obtainable from the fixture. This is accomplished by utilizing a generally shallow, rectangular fixture housing 10 employing a flat rectangular base 17 to which are attached vertical, elongated, rectangular side walls 14 and 15 and similar vertical end walls 16 (only one of which is shown in FIG. 1). The fixture itself is utilized in conjunction with conventional elongated tubular fluorescent bulbs, two of which, 11 and 12, are illustrated in FIG. 1. These bulbs are of standard type and typically are four feet (4') long, although other lengths also are commercially available. The electrical connections to the bulbs and their manner of operation is standard and has not been shown in FIG. 1 since it is not important to an understanding of the operation of the embodiment shown in the drawing.

In a typical fluorescent bulb lighting fixture, either for direct lighting or indirect lighting, the tendency for the light reflected from such a fixture to be projected in the form of strips of lighter and darker areas is overcome by placing a diffusion plate or cover over the open side of the fixture (which would be the top in the embodiment shown in FIGS. 1 and 2). Typically such a diffuser plate is a translucent cover having a waffle pattern or other pattern of light dispersing surfaces formed or scribed in it to accomplish the desired light dispersion. The use of such a translucent panel, however, reduces the efficiency of the fixture by approximately ten to fifteen percent, which, stated in other terms, means that ten to fifteen percent more energy or higher wattage bulbs or more bulbs must be used to obtain a given light output in any specific lighting environment.

The fixture shown in FIGS. 1 and 2 eliminates the need for a translucent cover panel over the fixture; so that it may be open, as illustrated, or covered with a clear glass cover. No light and dark striping of the light which emanates from the bulbs 11 and 12 in the fixture occurs because of the unique reflective surfaces which are placed on the base 17 of the fixture. This reflector accomplishes two major purposes. First of all, it operates to reflect the maximum amount of light issuing from each of the bulbs out of the fixture and minimizes the reflection of light (and heat) from a bulb back into the same bulb or from one bulb into an adjacent bulb. In addition, the reflecting surfaces are arranged to evenly disperse the light issuing from the bulb; so that a uniform, widely dispersed lighting effect is obtained. All of this is accomplished by utilizing specular surfaces or highly polished mirrored surfaces to obtain maximum reflection of all of the light impinging upon the surfaces. This is in contrast to the standard practice of simply using a glossy white enamel painted surface on a flat, rectangular interior surface of a box housing the fluorescent light bulbs 11 and 12.

As illustrated most clearly in FIG. 2, which shows the right-hand half of the fixture of FIG. 1 in cross-section, beneath each of the bulbs 11 and 12 is placed an elongated, inverted V-shaped reflector comprising two elongated rectangular strips 19 and 20. The apex of the V is located directly beneath the bulb on a line perpendicular to the plane of the base 17 of the housing and passing through the axis of the bulb 12 (and similarly the bulb 11). The strips 19 and 20 extend the entire length of the housing underneath the respective bulbs 11 and 12, and are parallel to the bulbs.

Located mid-way between the two bulbs 11 and 12 in the fixture is a second inverted V-shaped elongated reflector member comprised of two rectangular strips 39 and 40, which are similarly arranged with the apex of these strips extending upwardly (as viewed in FIGS. 1 and 2) into the space between the bulbs 11 and 12 and running parallel to the bulbs. The strips 39 and 40 are separated from the respective strips 19 and 20 of the adjacent reflectors located beneath the bulbs by elongated rectangular strips 21, each having a planar surface which is parallel to the surface of the base member 17 of the housing 10.

Similar strips 21 also are placed on the opposite sides (to the right of the strip 19 underneath the bulb 12 and to the left of the strip 20 underneath the bulb 11) and are located in a plane which is parallel to the base member 17 of the housing 10. Two additional elongated reflecting rectangular strips 25 then are located on opposite sides of the housing 10 adjacent the side walls 14 and 15, and rise at a slight angle to the point where they intersect or join with the vertical side walls 14 and 15.

All of the surfaces of the strips 19, 20, 21, 25, and the internal surfaces of the side walls 14 and 15 and the end wall 16 are mirrored or specular reflective surfaces. The angles "A", "C", and "B" shown in FIG. 2, along with the relative widths of the strips 19, 20, 21, 39, 40, and 25, are selected to cause a uniform dispersion of reflected light from the fixture, as indicated by the dotted line arrows shown in FIG. 2. Light which emanates from the bottom portion of the bulb 12 in a near vertical path (as indicated by the two dotted lines nearest the perpendicular center line through the bulb 12) strikes one or the other of the surfaces 19 or 20 and is reflected out of the fixture without being reflected back to the bulb 12. Similarly, light which extends at a somewhat greater angle (but still from the bottom half of the bulb) strikes the surfaces 21 on either side of the strips 19 and 20, and is reflected as indicated out of the fixture with a uniform dispersion. For the light which strikes the surface 21 on the side of the bulb nearest the vertical side wall 15, a double reflection takes place as that light is reflected from the surface 21 (or the surface 25) onto the reflective inner surface of the wall 15 (or 14) from which it is reflected out of the fixture.

Light issuing at a wider angle but still from the bottom half of the bulb 12 and extending toward the adjacent bulb 11 strikes the surface 39 which reflects it upwardly past the bulb 11; so that it is not lost or absorbed in the bulb 11. Similarly, light extending at a comparable angle from the bulb 11 strikes the surface 40 and is reflected out of the fixture past the bulb 12. If the surfaces 39 and 40 were not provided between the bulbs 11 and 12, a substantial amount of light issuing from each of these bulbs striking a flat surface between them would be reflected back into the adjacent bulb. This would result in a loss of efficiency or a reduction of the overall light output which could be obtained for a given energy input and wattage output for the bulbs used in the fixture.

As can be determined by an examination of the angles of the various reflective surfaces utilized in the fixture shown in FIGS. 1 and 2, very little light which issues at any angle from the bulbs 11 and 12 is reflected back into either of the bulbs or is directed from one bulb to the other. Essentially, the only light which undergoes this type of loss is that which extends horizontally from the sides of the bulbs 11 and 12. This light is reflected directly back into the respective bulbs from the adjacent vertical side wall surfaces 14 or 15, or is directed on a straight line path from one of the bulbs 11 or 12 to the other. In contrast with standard fixtures, however, this is a minimum amount of lost energy.

Specific dimensions which have been employed in commercial fixtures embodying the invention to obtain the even dispersal of light without requiring a diffusion plate over the top of the fixture are in a very shallow fixture utilizing side walls 14 or 15 only two inches (2") high. The strips 19 and 20 then are each 1.40 inches wide. The strips 39 and 40 are 1.1 inches wide, and the strips 21 are selected to be 0.675 inches wide. The distance from the center line of the bulbs 11 and 12 to the respective inner surfaces of the side walls 14 and 15 is 3.125 inches. This establishes a very shallow angle for the angles A and C of approximately twenty degrees for the angle A and approximately ten degrees for the angle C.

When a two-bulb fixture of the type shown in FIG. 1 is employed, the overall width of the fixture from side wall 14 to side wall 15 is 12.75 inches. Thus, the fixture is of a relatively narrow, shallow configuration which permits it to be conveniently used in a wide number of architectural and decorative arrangements.

Because of the wide dispersion of light obtained from the fixture as a result of the specular reflecting surfaces and their arrangements, uniform illumination on the ceiling above the fixture is attained, even though the fixture itself may be mounted a very short distance from the ceiling onto which the light is projected for the indirect lighting effect produced by the fixture. This is ideal for indirect lighting fixtures since the inverse square law by which the illumination falls off as the fixture is removed a greater distance from the ceiling or surface onto which it reflects requires indirect lighting fixtures to be located as close as possible to the ceiling or other surface onto which the light is projected. In a typical installation of a fixture of the type which is shown in the drawing, the distance between the fixture and the ceiling or other surface is approximately one and one-half to two feet. Again, this is an ideal situation which is difficult to attain with fixtures which do not provide the dispersal of light which is obtained from the fixture shown in the drawings.

The foregoing description of the preferred embodiment of the invention taken in conjunction with FIGS. 1 and 2 of the drawing is to be considered as illustrative of the principles of the invention and not as limiting. Various changes and modifications will occur to those skilled in the art. For example, the fixture easily may be expanded into a multiple-bulb fixture having more than two bulbs 11 and 12. This is readily done simply by employing additional numbers of reflector strips arranged in the same manner as illustrated for the two bulbs 11 and 12 of the embodiment which was shown. Furthermore, by employing bulbs of different diameters, slightly different angular variations, and variations in the widths of the reflecting surfaces 19, 20, 21, 39, 40 and 25, also may be employed to optimize the light output from the fixture without departing from the true scope of the invention.

I claim:

1. An indirect multiple bulb fluorescent light fixture including in combination:

an elongated rectangular housing having a base located beneath the bulbs of the light fixture;

first pairs of elongated substantially flat reflector strips arranged as first inverted V-shaped reflector member on said base located beneath each bulb, with the apex of each of said first V-shaped reflector members located in alignment with the axis of the bulb which it underlies on a line perpendicular to the plane of said base; and a second pair of elongated substantially flat reflective strips arranged as a second inverted V-shaped reflector member located on said base between the bulbs and extending parallel thereto, the angles formed between the strips of said first and second reflector members and said base and between said reflector members and the bulbs being selected to minimize light reflected back into the bulbs from said reflector members and to cause uniform widely dispersed illumination on the ceiling above the fixture.

2. The combination according to claim 1 wherein said first and second V-shaped reflector members and areas of said base exposed to light from the bulbs have specular surfaces.

3. The combination according to claim 1 wherein said first and second V-shaped members are separated by flat, elongated, reflective strips in the same plane as the plane of the base of said rectangular housing.

4. The combination according to claim 3 wherein said first and second elongated V-shaped reflector members and said elongated flat reflective strips have specular surfaces.

5. The combination according to claim 1 wherein said elongated rectangular housing has at least first and second side walls extending vertically from said base on opposite sides thereof and extending parallel to the bulbs in the fixture, said side walls and said reflector members and said base having specular surfaces.

6. The combination according to claim 5 further including a flat reflective strip between said first and second inverted V-shaped reflector members, said flat reflector strip having a surface in a plane parallel to the plane of said base of said rectangular housing and extending parallel to the bulbs in said fixture.

* * * * *